United States Patent [19]

Sienkiewicz et al.

[11] 4,236,678

[45] Dec. 2, 1980

[54] ENDLESS RIBBON CARTRIDGE

[75] Inventors: Gerald C. Sienkiewicz; Donal J. McQuade, both of Raleigh; Herbert G. Leonard, Louisburg, all of N.C.

[73] Assignee: International Business Machines Corporation, Armonk, N.Y.

[21] Appl. No.: 746

[22] Filed: Jan. 3, 1979

[51] Int. Cl.[3] ..... B65H 17/48

[52] U.S. Cl. ..... 242/55.19 A; 242/71.8

[58] Field of Search ..... 242/55.19 R, 55.19 A, 242/71.8, 71.9, 118.4–118.62, 55.16–55.18

[56] References Cited

U.S. PATENT DOCUMENTS

| | | | |
|---|---|---|---|
| 3,220,663 | 11/1965 | Plato | 242/71.8 |
| 3,532,283 | 10/1970 | Kawata | 242/55.19 R |

FOREIGN PATENT DOCUMENTS

| | | | |
|---|---|---|---|
| 1324300 | 3/1963 | France | 242/71.8 |

*Primary Examiner*—Leonard D. Christian
*Attorney, Agent, or Firm*—Edward H. Duffield

[57] ABSTRACT

A freely rotatable spool having an endless loop of printer ribbon wound around it is disclosed. The ribbon is withdrawn from the inner periphery of the coil and is simultaneously wound onto the outer periphery of the coil in a known manner. The freely rotatable spool is driven by the forces applied through pulling the ribbon off the inner periphery. Ribbon pulling is performed by an external set of feed rollers or similar mechanism. Difficulties encountered with the use of fabric ribbons in endless reel configurations are eliminated in the present invention by an improvement in the form of a polygonally shaped flange on the upper side of the freely rotatable spool on which the ribbon is wound. The flat sides on the polygonal flange have an optimum length which is defined in relationship to the width of the ribbon and the cosine of the angle at which the ribbon is withdrawn from the spool. An undercut dimension is provided on the spool so that the inner periphery of the ribbon is not in too great a contact with the hub or central core of the spool. A smooth ribbon flow from the vertical plane on the inner periphery of the coil to the horizontal plane as the ribbon is pulled from the center of the coil and out through the cassette is obtained.

3 Claims, 5 Drawing Figures

ENDLESS RIBBON CARTRIDGE

TECHNICAL FIELD

This invention relates generally to reeling and spooling of web materials, particularly those of the endless loop type typically employed in cassettes.

Prior Art

A variety of endless web spool cassettes in which a continuous coil of web material is wound on a free running hub and in which the web or ribbon is withdrawn from the inner periphery while it is being rewound on the outer periphery of the coil are known. Such cassette tape, web or ribbon devices are well known in the art. See for example U.S. Pat. Nos. 3,770,223, 3,337,150, 2,778,635, 3,025,012 or 3,295,781. In each of these mentioned patents, a free running hub on which the endless coil of ribbon is wound is employed. Generally, the forces applied to the ribbon to withdraw it from the inner periphery turn the hub of the spool on which the ribbon is coiled and thus produce the tensioning or rewind effect on the outer periphery where the ribbon again enters the cassette. Clear examples of this exist in U.S. Pat. No. 3,770,223 and the mentioned undercutting of the hub of the spool is shown as well in U.S. Pat. No. 3,025,012.

A primary difficulty with printing ribbons, particularly of the fabric type, when employed in this type of device have been a tendency of the ribbon to stick or frictionally jam causing uneven feeding and jerkiness which will adversely affect the quality of printing in many circumstances. The difficulty is compounded in many of the prior art designs because of the fact that the combined pressure built up in all of the outer windings and the friction which it generates at the point of exit where the ribbon is withdrawn from the inner periphery of the ribbon roll is significant. Undercutting of the spool to limit the amount of area contact between the inner surface of the ribbon and the spool has been employed as noted above. However, there is still a significant problem with puckering, gathering and poor feeding of the ribbon as it is pulled from the surface of the spool and is turned 90° to pass in the horizontal direction across the flat side of the coil. The reasons for these difficulties lie in the fact that built-up pressure on the innermost coil from the multiple outer coils of the ribbon still exists. This results in uneven feeding of the ribbon and necessitates excessively high pull out forces. These forces may not be easily accommodated without a carefully constructed and more costly ribbon withdrawing apparatus. Additionally, uneven feeding may result in uneven winding, further compounding the difficulties.

OBJECTS OF THE INVENTION

In view of the foregoing difficulties in the known prior art, it is an object of the present invention to provide an improved cartridge or cassette for an endless loop of inked ribbon or similar web materials in which the ribbon or web can be more freely and easily withdrawn with a minimum of friction.

SUMMARY

The objects of this invention are met by providing an improved spool having a polygonal flange on one side of the coil facing the side thereof from which the innermost periphery is withdrawn as the ribbon is needed. In the preferred embodiment, a semi-hexagonal configuration is used for the top flange and the bottom flange is of the ordinary circular shape. The use of the semihexagonal top flange on the spool allows the ribbon roll to maintain the circular shape of the bottom flange while the six radial points of the polygonally shaped top flange allow the ribbon a maximum of pressure relief upon pull out. This reduces even the slight puckering that is usually experienced to a bare minimum. A smooth flow or transition from the inner periphery of the coil with the ribbon in a vertical plane to the ribbon in a horizontal plane as it is pulled from the center and out across the coil is obtained. The optimum length of the flats on the polygon shape of the top flange is a function of the angle at which the ribbon is pulled from the spool and the width of the ribbon.

BRIEF DESCRIPTION OF THE DRAWINGS

The foregoing and still other unenumerated objects of the invention are met in the preferred embodiment of the present invention as will now be described with reference to the following drawing in which.

DETAILED SPECIFICATION

Figure 1:
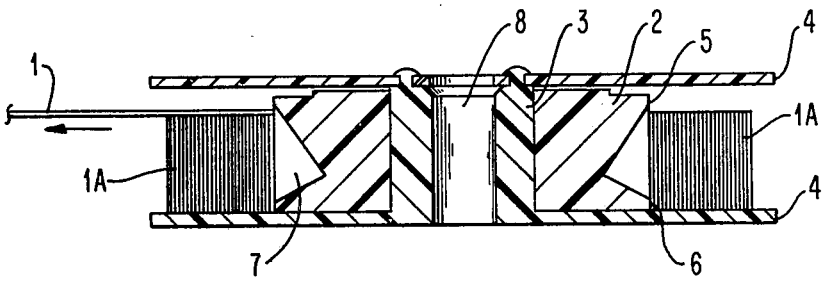
FIG. 1 illustrates a horizontal cross-sectional view through the center of the spool and flange arrangement with the ribbon wound upon the spool.

In FIG. 1 an endless web or ribbon 1 is shown wound into a coil 1A supported on a freely rotatable spool 2 which rides on a hub 3 enclosed by top and bottom sides 4. This combination may generally be referred to as a cassette containing a reel as shown. The innermost coil from the web coil 1A is continuously withdrawn by means not illustrated and is rewound upon the outer periphery of the coil.

The manner of withdrawal and the manner in which the spool is rotated by the forces generated in withdrawing the web or ribbon from the innermost coil and how this causes rewinding upon the outermost coil by the rotation of the spool are all well known in the art and do not form a part of this invention. The general process has long been employed in a variety of applications and hence, a description of the unwinding and rewinding process which continuously occurs can be dispensed with herein.

As mentioned above, a significant problem with devices of the type shown in FIG. 1 generally is that the combined pressure from the outer coils of the web on the innermost coil forces the ribbon into tight engagement with the surface of the spool and create frictional forces that must be overcome to withdraw the ribbon from the spool. Since withdrawal occurs from the innermost periphery of the coil and causes rotation of the spool there is both a vertical sliding friction as the innermost coil is withdrawn and a horizontal sliding friction as that ribbon turns into the horizontal plane and slides across the top surface of the coil between the covers of the cassette which houses the spool. Particularly with fabric inked ribbons for use in printing machines, this poses a significant problem due to the higher frictional characteristics of fabric ribbons. The frictional forces generated are often great enough to cause uneven feeding and winding and may even be significant enough so as to cause jamming to occur. All of these contribute to an undesirable deterioration in the quality of printing since fresh ribbon is not smoothly available.

In FIG. 1, spool 2 is provided with an upper flange 5 and a lower flange 6. The upper flange 5 has a slightly smaller radial dimension than the bottom flange 6 for a purpose that will be described later. Spool 2 is supported on a hub 3 that can form the core of the cassette used for mounting the top and bottom covers 4 as shown. Spool 2 is freely rotatable on the hub 3 and may preferably be made of nylon or filled nylon or similar smooth running low cost plastic material.

The surface of spool 2 between its flanges 5 and 6 is undercut as shown generally as the undercut or cut out portion 7 to relieve contact between the inner surface of the coil of ribbon and the outer surface of the spool as is well known in the art. In the preferred embodiment shown, the length of the undercut should be equal to or greater than the width of the ribbon. This will be described in greater detail later.

Figure 2:
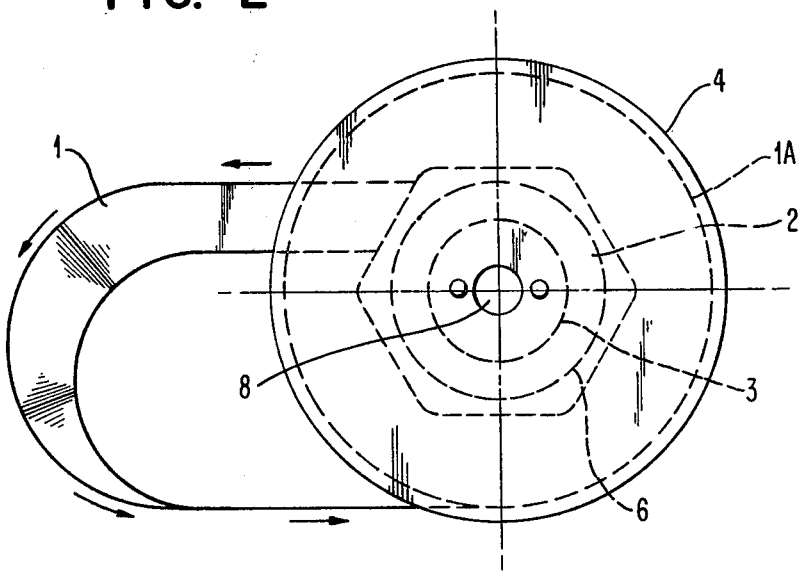
FIG. 2 illustrates a top plan view of the apparatus shown in FIG. 1.

Turning to FIG. 2, a top or plan view of the cassette shown in FIG. 1 is illustrated. In FIG. 2, it may be seen that the top flange 5 has a polygonal shape which is specifically in the preferred embodiment, hexagonal although any polygonal shape with or without equal length sides may be employed. It may also be seen that the radial distance from the center of hub 3 to the extremity or point on the polygonal upper flange 5 is less than the radial distance from the same center of hub 3 to the periphery of the lower flange 6. Reel 2 runs freely on the surface of hub 3 which may have an internal aperture 8 suitable for mounting the entire apparatus on a stud or other fixed element in a printing machine where the cassette may effectively be used. The upper and lower covers 4 are of similar dimension and appear as a single cover in FIG. 2. It may be observed from the schematic diagram of ribbon 1 in FIG. 2 that the ribbon is withdrawn from the inner periphery of the coil 1A past the flat sides of the polygonal upper flange 5 into the horizontal plane as it crosses the top of the coil 1A between the cover 4 and the top surface of the coil 1A before it exits for use and is then rewound upon the outer periphery of the coil.

Figure 3:
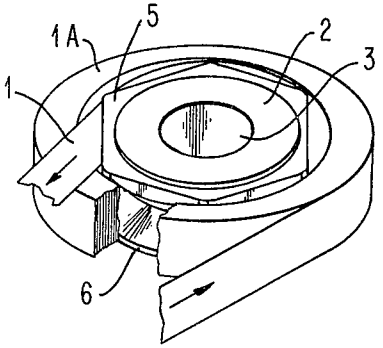
FIG. 3 is a semi-pictorial view with the top cover of the cassette removed to show the operation of the web, spool and flanges.

Turning to FIG. 3, a semi-pictorial view of the feeding process with the cover 4 removed on the top and the bottom is shown. In FIG. 3, ribbon 1 is withdrawn in the direction of the arrow from the inner periphery of the coil 1A and is rewound on the outer periphery of the coil by rotation of the spool 2 on hub 3 which is generated by the forces of withdrawing ribbon 1 from the inner periphery in a manner well known in the art. p In FIG. 4 a top or plan view of the preferred embodiment of the spool utilized in the present invention with its upper flange 5 is shown. The length of the flat side of the polygon forming the top flange 5 is indicated as H and the width of the ribbon 1 is W. The angle A at which ribbon 1 is withdrawn from the inner periphery is shown as A and this angle affects the preferred length H of the polygonal faces on top plan 5 in accordance with the width of the ribbon as described by the formula $H=W/\cos A$.

Figure 5:
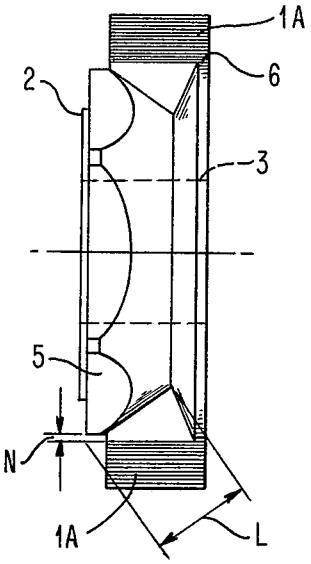
FIG. 5 is a horizontal elevational view of the preferred embodiment of the apparatus shown in FIG. 4.
Figure 4:
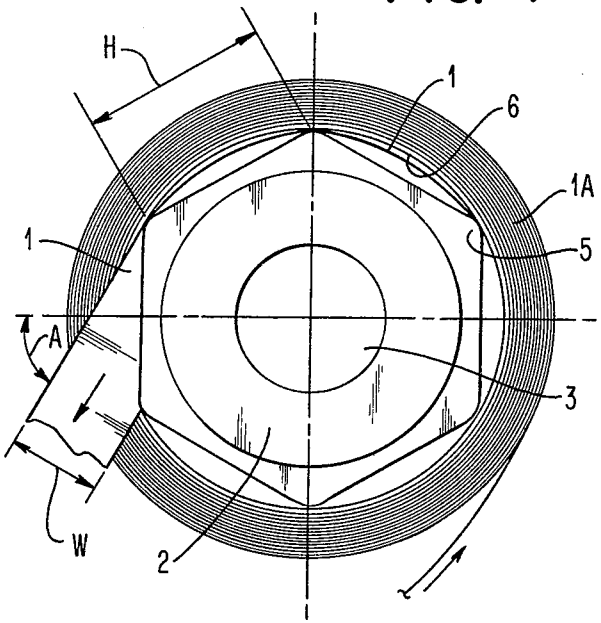
FIG. 4 is a schematic top or plan view of the improved apparatus showing the relationship of the width of the web and the angle of withdrawal from the coil as related to the length of the polygonal sides of the top flange of the spool.

In FIG. 5 a horizontal cross-section through the preferred embodiment shown in FIG. 4 is illustrated. It will be seen that the upper flange 5 that has the polygonal surface or shape is slightly smaller by dimension N than the circular flange 6 which forms the bottom of the spool 2. It will be seen that the coil 1A so formed will ride against the circular flange 6 and assume its circular shape. Ribbon 1 is wound around the circular flange 6 of spool 2 and the hexagonal flange points 5 are preferably recessed by a dimension N that is at least two ribbon thicknesses so that the hexagonal points of flange 5 will lie in a diameter of a circle which is approximately four ribbon thicknesses less than the diameter of the circular flange 6.

ADVANTAGES AND APPLICATIONS

It has been found that a cassette constructed according to the preferred embodiment of the present invention and containing the wound endless loop of fabric ribbon, for example, provides a more freely rotatable spool and cassette combination for a smooth and easy flow of ribbon from the central periphery of the coil and a rewinding thereof on the outer periphery than prior art devices of similar type. A minimum pull out force requirement is provided by this design which enhances the usefullness of the same for employment in printing machines in general. It is only necessary to mount the cassette in any desired orientation and provide pull out rolls or feed wheels to withdraw the ribbon from the inner periphery of the coil. The ribbon may be fed through the printing machine and will be drawn back and rewound on the outer periphery of the coil within its cassette by the forces produced in withdrawing the ribbon from the innermost periphery of the coil.

Having thus described our invention and its method of construction and operation with reference to a preferred embodiment thereof, what we intend to claim is:

1. An improved cassette apparatus for an endless loop of wound web material in which a freely rotatable spool bearing said wound web is housed within a casing and provided with means for allowing said ribbon to be withdrawn from the innermost coil of said winding on said spool and rewound on the outermost coil thereof, the improvements comprising:

said freely rotatable spool is provided with a first polygonally shaped flange of smaller maximum exterior dimension than the minimum internal diameter of said coil and said flange is located adjacent to one edge surface of said wound coil, said flange being encircled by said coil; and a second flange on said spool facing the opposite edge surface of said coil and being provided with a circularly shaped flange surface on which the innermost coil of said ribbon is wound.

2. Apparatus as described in claim 1, wherein:

the diameter of said circularly shaped flange of said spool is greater than the maximum dimension across the points of said polygonal surface of said first flange.

3. Apparatus as described in either claim 1 or claim 2, wherein:

the length of each side of said polygonal flange is defined with relationship to the width of said ribbon and the angle of withdrawal of said ribbon from said spool by the relationship that the length of said side of said polygon is equal to the width of said ribbon divided by the cosine of said angle of withdrawal.

* * * * *